US009028288B2

(12) United States Patent
Lovett

(10) Patent No.: US 9,028,288 B2
(45) Date of Patent: May 12, 2015

(54) FLOATING MOUNTING BASE FOR AN UMBRELLA

(71) Applicant: Jeffrey Lovett, Carrollton, TX (US)

(72) Inventor: Jeffrey Lovett, Carrollton, TX (US)

( * ) Notice: Subject to any disclaimer, the term of this patent is extended or adjusted under 35 U.S.C. 154(b) by 50 days.

(21) Appl. No.: 14/045,229

(22) Filed: Oct. 3, 2013

(65) Prior Publication Data

US 2014/0227920 A1 Aug. 14, 2014

Related U.S. Application Data

(60) Provisional application No. 61/762,926, filed on Feb. 10, 2013.

(51) Int. Cl.

| | |
|---|---|
| ***A45B 3/00*** | (2006.01) |
| ***B63B 22/24*** | (2006.01) |
| ***A45B 23/00*** | (2006.01) |

(52) U.S. Cl.

CPC . *A45B 3/00* (2013.01); *B63B 22/24* (2013.01); *A45B 23/00* (2013.01); *A45B 2023/0006* (2013.01); *A45B 2200/1009* (2013.01); *A45B 2200/1054* (2013.01); *A45B 2200/1063* (2013.01)

(58) Field of Classification Search

CPC ..... A45B 25/00; A45B 3/00; A45B 5/00; B63B 22/00; B63B 22/24

USPC ..... 441/1, 21, 22, 28, 29, 30, 32, 35, 38, 441/136; 135/16; 405/218, 219; 472/128

See application file for complete search history.

(56) References Cited

U.S. PATENT DOCUMENTS

| | | | | |
|---|---|---|---|---|
| 3,802,007 | A * | 4/1974 | Dolan, Jr. | 441/136 |
| 5,505,645 | A * | 4/1996 | Engler, Jr. | 441/1 |
| 6,139,382 | A * | 10/2000 | Eschbacher et al. | 441/32 |
| 2005/0189005 | A1* | 9/2005 | Smith et al. | 135/16 |
| 2006/0070643 | A1* | 4/2006 | Markert | 135/16 |
| 2012/0090525 | A1* | 4/2012 | Montgomery | 441/1 |

* cited by examiner

*Primary Examiner* — Lars A Olson
(74) *Attorney, Agent, or Firm* — Howison & Arnott LLP

(57) ABSTRACT

A floating mounting base for a vertical support for use in water includes a base housing defining an interior chamber having an opening at a top of the base housing for maintaining a weighting material below a surface of the water to maintain the vertical support in a substantially vertical position. The base housing further defines a support chamber for supporting the vertical support in the substantially vertical position. A lid encloses the interior chamber from an external environment. The lid defines an opening aligned with the support chamber enables the vertical support to be inserted through the lid and into the support chamber. A bottom of the circular base housing is insertable within an opening of a float ring and one of the base housing or the lid defines a surface for engaging the float ring and preventing the float ring from moving past the lid.

18 Claims, 6 Drawing Sheets

FLOATING MOUNTING BASE FOR AN UMBRELLA

CROSS-REFERENCE TO RELATED APPLICATIONS

This application claims priority to U.S. Provisional Application Ser. No. 61/762,926, filed on Feb. 10, 2013, entitled A FLOATING SHADE BASE FOR AN UMBRELLA, which is incorporated herein by reference in its entirety.

TECHNICAL FIELD

The present invention relates to umbrella and pole bases, and more particularly to a floating umbrella or pole base.

BACKGROUND

Umbrella, sign or flag bases have long been known and are widely used. The bases are configured to receive a pole or staff and to maintain the pole or staff in a vertical position. The majority of existing umbrella, sign or flag bases have been configured for use on land. However, due to the widespread use of pools, lakes, oceans or other types of water activities, there has arisen a need for an umbrella, sign or flag base that will support an umbrella, sign or flag pole or staff, while at the same time providing a floating base. The floating base must be stable while maintaining the umbrella, sign or flag pole or staff in an upright, vertical position.

SUMMARY

The present invention, as disclosed and described herein, in one aspect thereof, comprises a floating mounting base for a vertical support for use in water that includes a base housing defining an interior chamber having an opening at a top of the base housing for maintaining a weighting material below a surface of the water to maintain the vertical support in a substantially vertical position. The base housing further defines a support chamber for supporting the vertical support in the substantially vertical position. A lid encloses the interior chamber from an external environment. The lid defines an opening aligned with the support chamber enabling the vertical support to be inserted through the lid and into the support chamber. A bottom of the base housing is insertable within an opening of a float ring and one of the base housing or the lid defines a surface for engaging the float ring and preventing the float ring from moving past the lid.

BRIEF DESCRIPTION OF THE DRAWINGS

For a more complete understanding, reference is now made to the following description taken in conjunction with the accompanying Drawings in which.

DETAILED DESCRIPTION

Figure 1:
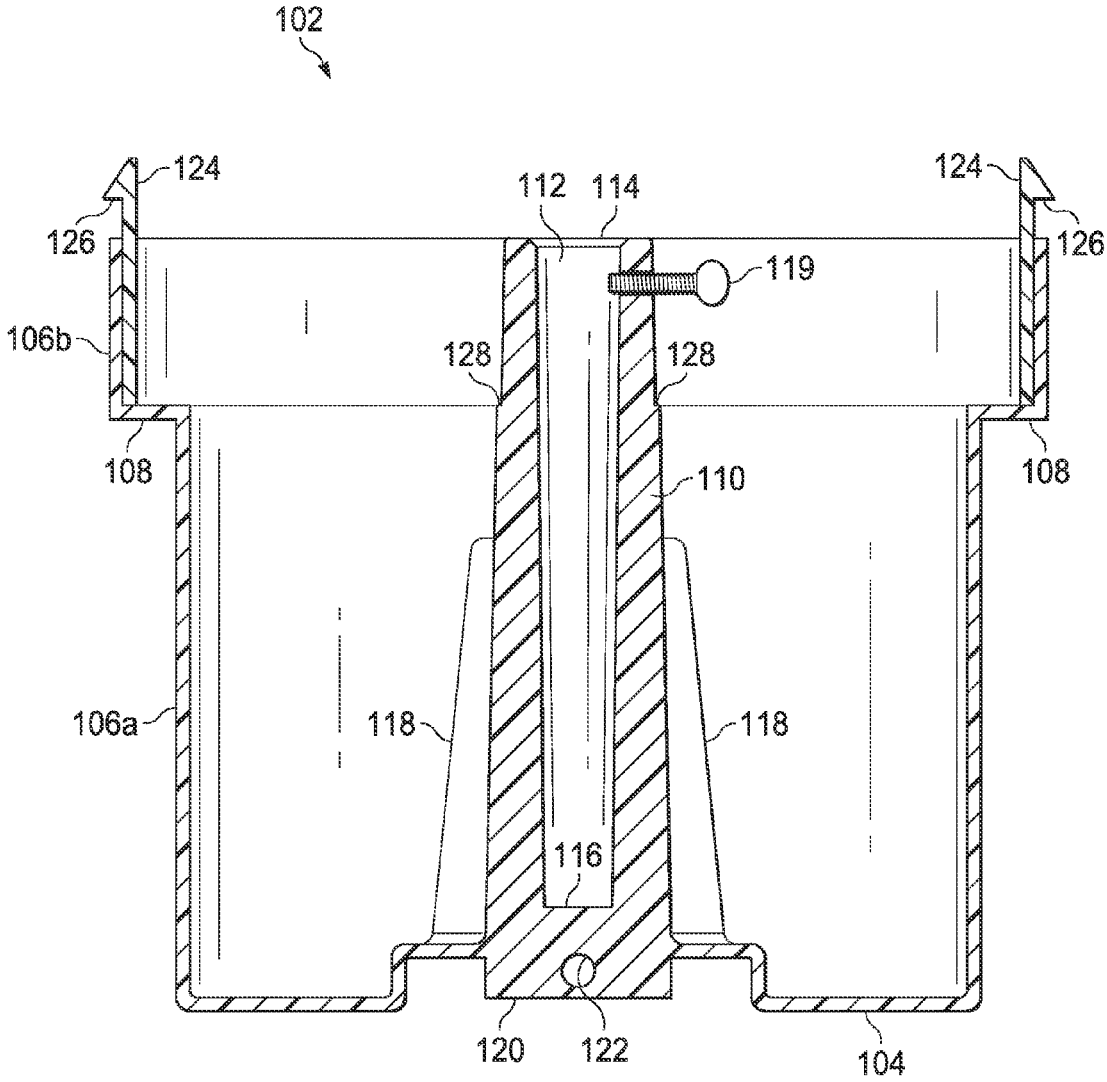
FIG. 1 is a cross-sectional view of the base housing.

Referring now to the drawings, wherein like reference numbers are used herein to designate like elements throughout, the various views and embodiments of the floating shade base for an umbrella are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Figure 2:
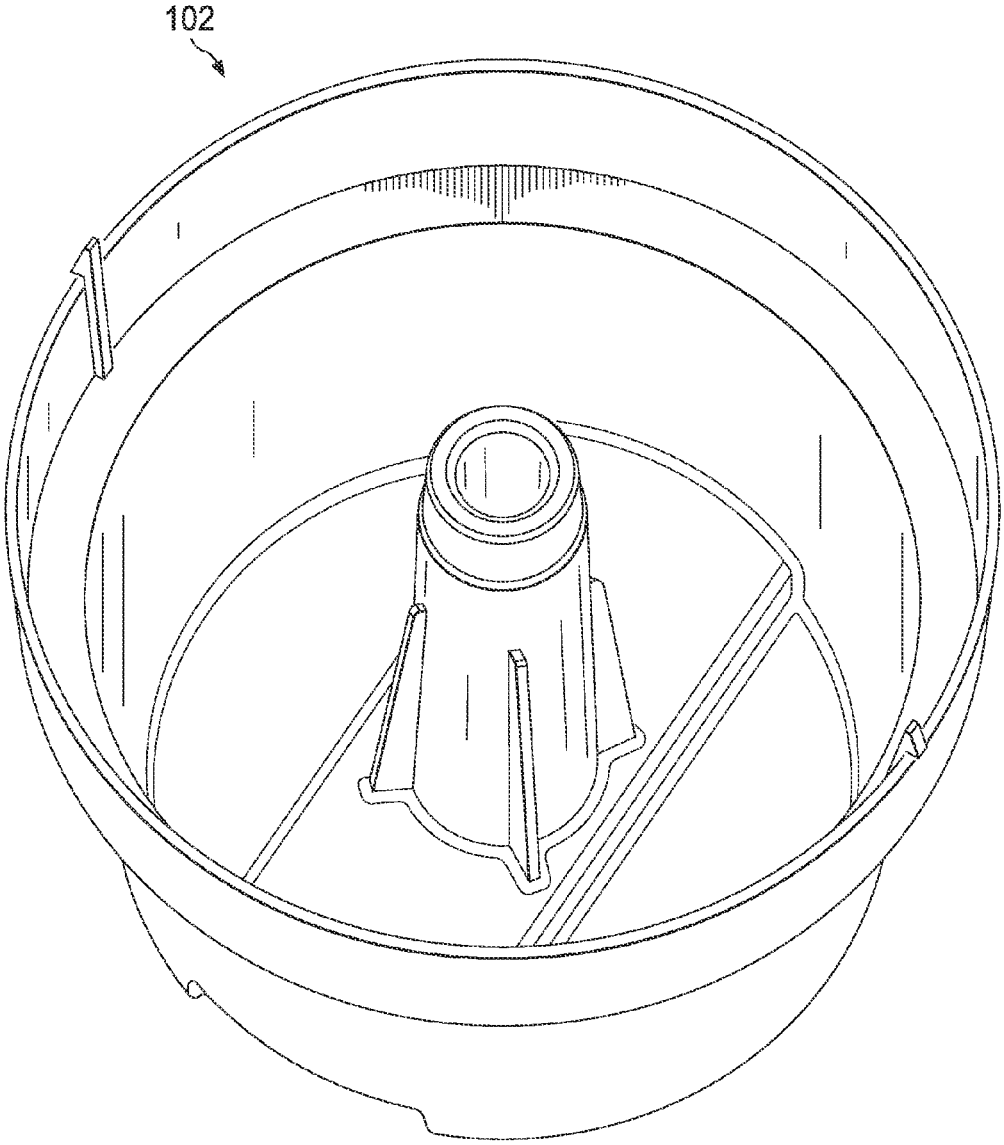
FIG. 2 is a perspective view of the base housing.

Referring now to the drawings, and more particularly to FIGS. 1 and 2, there are illustrated a cross-sectional view of a base housing 102 and a perspective view of the base housing 102. The base housing 102 provides stability by differentiating water used as weight, from water in which the base housing is floating. The base housing 102 provides the primary resistance to external forces that would cause tipping or otherwise non-vertical support of the umbrella staff 604. The base housing 102 includes a circular bottom 104. From the edges of the circular bottom 104 rises a housing wall 106. The housing wall 106 has a same diameter as the exterior edges of the circular bottom 104 on a lower portion 106*a* of the housing wall 106. An upper portion 106*b* of the housing wall 106 has a greater diameter than the lower portion 106*a* of the housing wall 106. The upper portion 106*b* and lower portion 106*a* of the exterior wall 106 are interconnected via a ledge 108. The housing wall 106*a* and 106*b* diameter may be inverted from this if materials allow for it. Thus, the taper will be in either a tapered configuration that increases or decreases when going from the bottom 104 to the top edges. The configuration with the larger bottom 104 provides more stability.

Rising from the circular bottom 104 of the base housing 102 is a pole support pillar 110. The pole support pillar 110 is a conically shaped housing rising from the circular bottom 104. The pole support pillar 110 has a larger diameter at its base next to the circular bottom 104 than at its upper end 112. The pole support pillar 110 additionally defines a bore 112 for receiving an umbrella pole, flagpole or sign pole. The bore 112 has a larger diameter at its open end 114 than it does at its terminating end. This is to enable differing size poles to be securely affixed within the bore 112. A pole that initially fits within the bore 112 will eventually come into contact and be secured by the sides of the bore 112 as it travels towards the terminating end 116. Providing additional support to the pole support pillar 110 are various support vanes 118 providing vertical support between the circular base 104 and the sides of the pole support pillar 110. A thumb screw 119 (or other securing device) threaded through support pillar 110 keeps the umbrella from rising out of base housing 102.

An anchoring tab 120 is a rectangular shaped tab that extends below the circular bottom 104 and defines an opening 122 therein. The anchoring tab 120 allows a rope or cable to be connected to the opening 122 and an anchor or other tie down attached to the base housing 102 to keep it from floating around and in a tethered position.

The base housing 102 additionally defines a number of securing tabs 124 along a top edge of the upper surface 106*b* of the exterior wall 106. The securing tabs 124 are configured to flex in a first direction and secure a lid to the base housing as will be described more fully herein below. In the present configuration, the securing tabs 124 define a latching ledge 126 that secures a lid to the top opening of the base housing 102.

Figure 3:
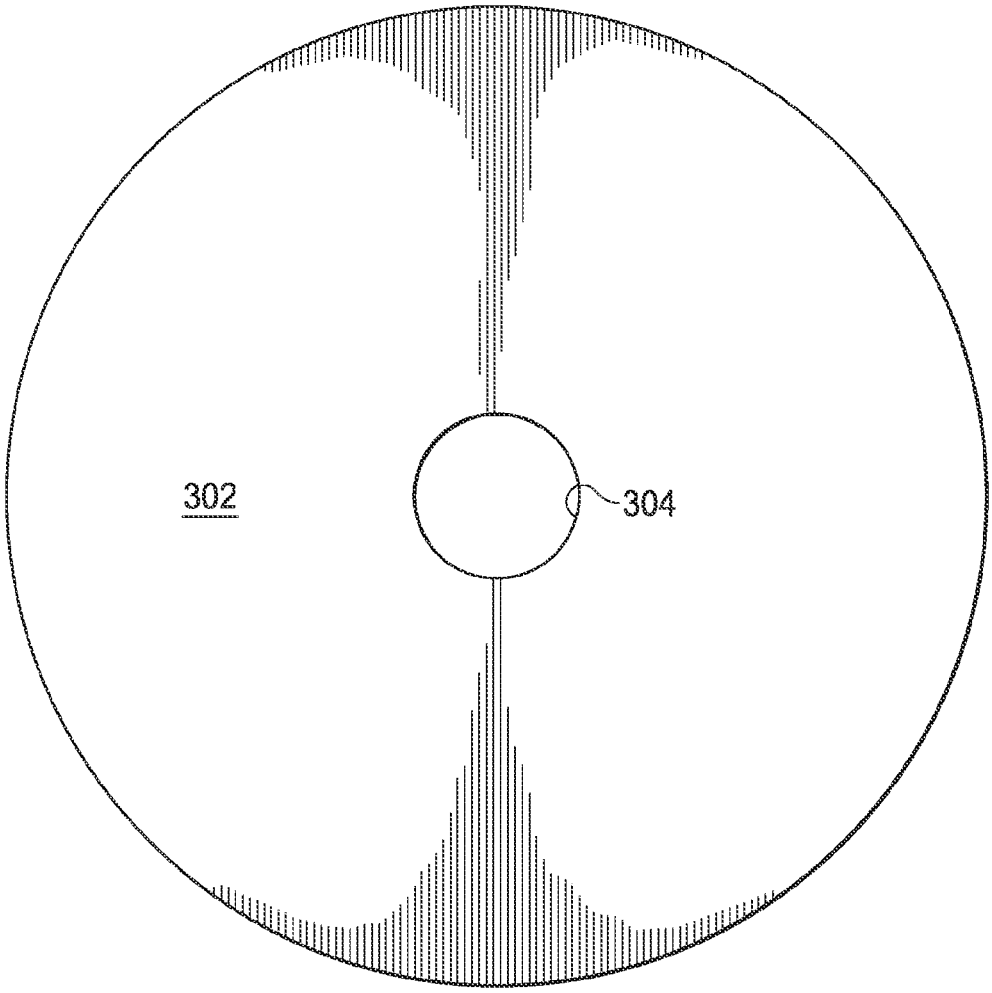
FIG. 3 is a top view of the base gasket.

Referring now also to FIG. 3, there is illustrated a housing gasket 302. The housing gasket 302 is used to prevent sand or other items from escaping base housing 102. The housing gasket 302 may comprise a rubber or other type of sealing material in the shape of an annular ring. An opening 304 within the interior of the gasket ring 302 goes over the upper portion of the pole support pillar 110. The bottom side of the gasket side 302 then rests on the housing wall ledge 108 defined within the housing wall 106 and a pole support pillar ledge 128 defined within the outer surface of the pole support pillar 110. In this manner, the housing gasket 302 will rest in the upper portion of the base housing 102 and prevent sand and other unwanted materials from escaping base housing 102 defined by the lower portion 106*a* of the housing wall 106.

Figure 4:
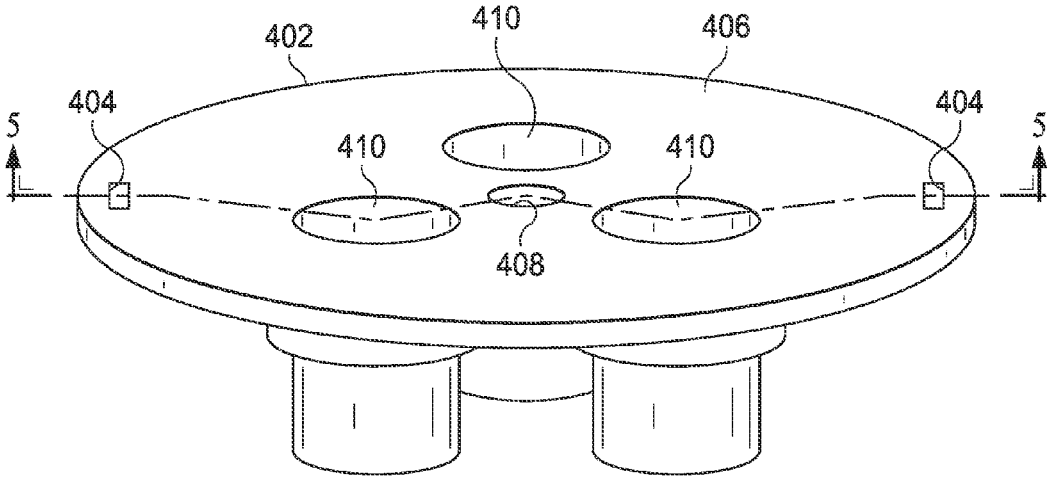
FIG. 4 is a perspective view of the base housing lid.
Figure 5:
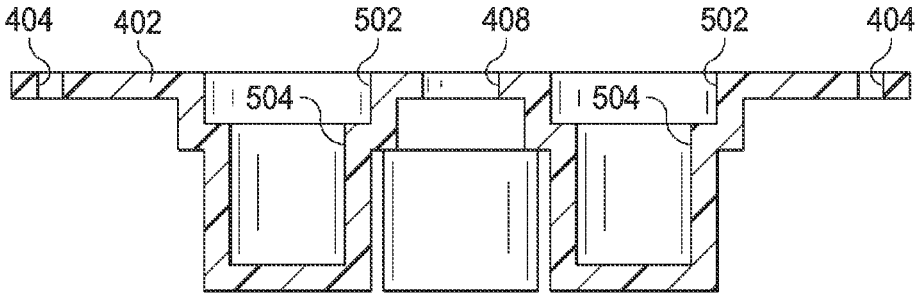
FIG. 5 is a cross-sectional view of the base housing lid.

Referring now to FIGS. 4 and 5 there are illustrated a perspective view of the base housing lid 402 and a cross sectional view of the base housing lid 402. The base housing lid 402 comprises a substantially circular disc that cover the open end of the base housing 102. The base housing lid 402 when placed on the base housing 102 prevents water and other materials from entering into the interior of the base housing. The base housing lid 402 defines therein openings 404 for receiving the securing tabs 124 defined with on the upper portion 106*b* of the exterior wall 106 of the base housing 102. When the securing tabs 124 slide within the openings 404, the latching ledge 126 will engage a top surface 406 of the base housing lid 402 and secure the base housing lid 402 in place. The base housing lid 402 further defines an opening 408 for receiving an umbrella pole. The opening 408 is placed in such a manner to line up with the opening 114 of the pole support pillar 110 within the base housing 102.

The base housing lid 402 additionally defines a number of cup holders 410. The cup holders 410 are defined by a larger upper ring portion 502 and a lower smaller diameter ring portion 504. This will enable cups of differing size to be placed in either the upper ring 502 or lower ring 504, or alternatively, enable a user to grasp the top of a container held within the lower ring 504. Lower ring 504 also presses against gasket 302 to provide a seal and secure it in place.

The base housing lid 402 and base housing 102 may be constructed entirely of common plastic injection molded raw materials such as nylon, polyethylene, polyvinylchloride or polypropylene but is not limited to these materials. In a further embodiment, the lower portion 106*a* of the housing wall 106 and the pole housing 110 may additionally be constructed of a watertight flexible material. This will enable these portions of the base housing 102 to be collapsed into a transportable configuration.

Figure 6:
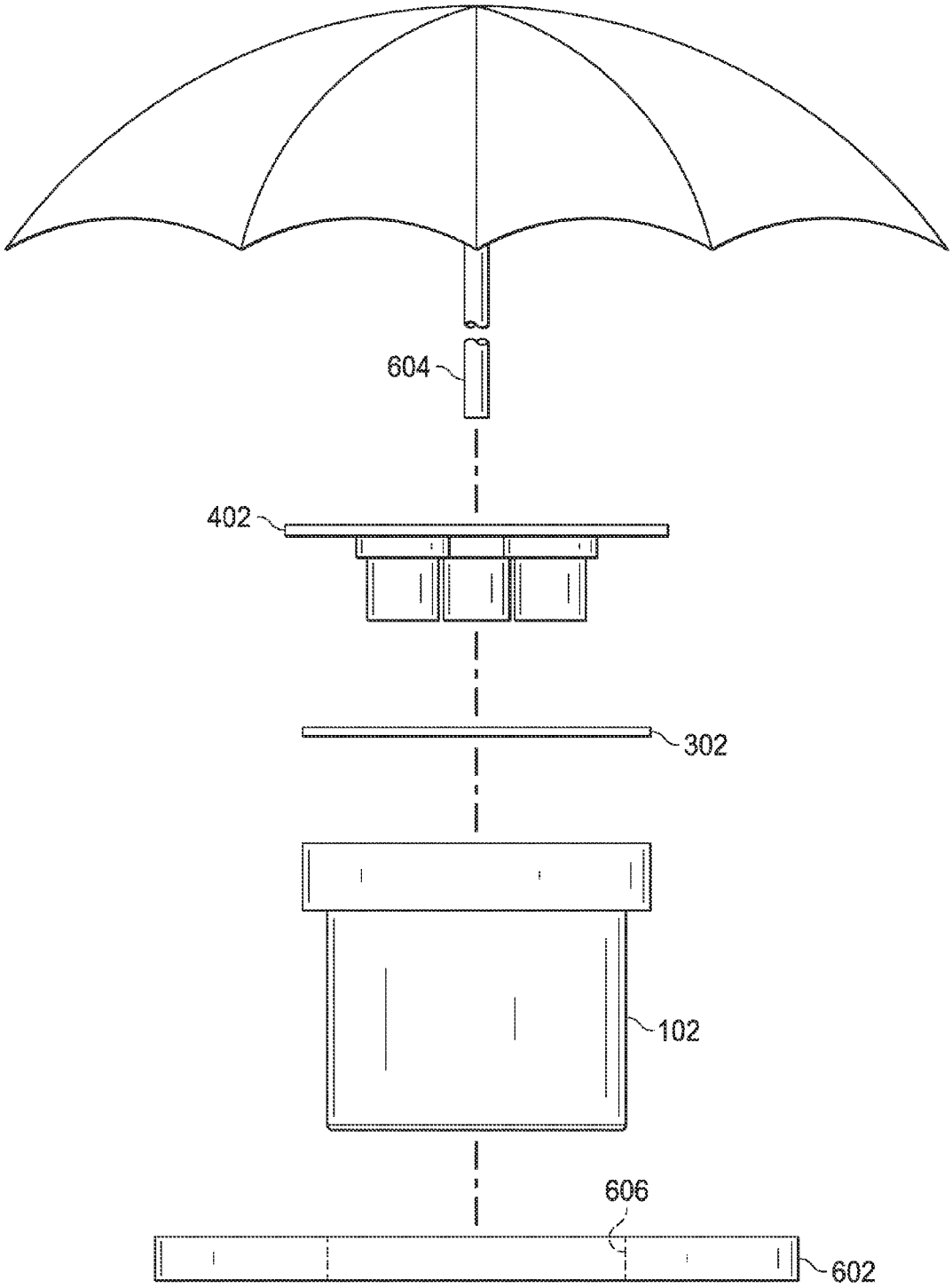
FIG. 6 is a side view illustrating the interconnection of the base housing, base gasket, base lid, a float and an umbrella.

Referring now to FIG. 6, there is illustrated the manner in which the base housing 102, housing lid 402 and housing gasket 302 are inter-connected with a float 602 and flagpole 604 in order to utilize the floating housing in a preferred manner. The housing gasket 302 is inserted within the base housing 102 to rest on the ledges 108 and 128 as described previously herein. Before the gasket 302 is placed, water, sand, gravel or some other type of weighting material may be added within the bottom portion of the base housing 102 in order to counteract the weight of an umbrella or other pole. The weighting material is thus maintained below the surface of the water within the base housing 102. Once the housing gasket 302 and any weighting material are placed within the base housing 102, the housing lid 402 is placed upon the top of the base housing 102 and secured in place via the securing tabs 124. Some type of ring float 602 may be placed around the base housing 102. The ring float 602 may comprise a life-saving ring or inflatable ring type float to provide buoyancy to the base housing 102. The only requirement with respect to the ring float 602 is that the inner ring opening 606 be of sufficient size to fit around the base housing 102 yet not too large to exceed the edges of the base housing lid 402. Thus, the buoyancy of the ring float 602 will force the ring float upward until it comes in contact with the base lid 402 or the upper portion 106*b* of the exterior wall 106. The umbrella staff 604 is inserted into the opening in the base lid 402 and into the pole support pillar 110 within the interior of the base housing 102. In this manner the umbrella and umbrella staff 604 are held in an upright position that floats upon the water.

Figure 7:
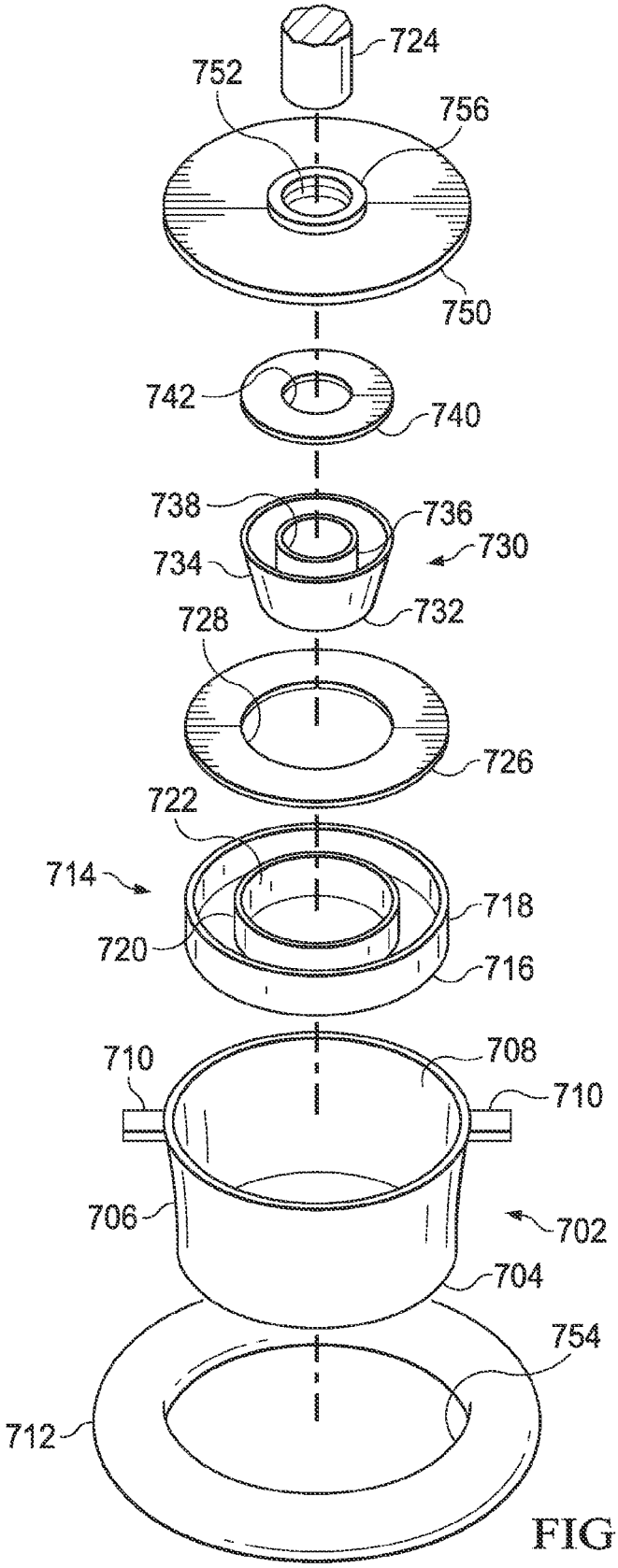
FIG. 7 is a perspective view of a further embodiment of an umbrella base float.

Referring now to FIG. 7, there is illustrated an alternative embodiment of the floating mounting base. In this embodiment, the floating mount includes a base container 702. The base container 702 include a bottom portion 704 having a side wall 706 extending upward from the edges thereof defining an interior area for containing weighting material and maintaining it below the surface of the water. The side wall 706 defines an opening 708 for providing access to the interior of the base container 702. The base container 702 further comprises a pair of handles 710 for carrying the floating mounting base and securing a float ring 712 thereto. Alternative to the handle 710, a curved lip or edge may be defined upon the housing container 702 or on the lid 750 in order to support the floatation ring 712.

A base insert cylinder 714 provides a container for holding sand, water, gravel or other weighted material that may be placed inside the base container 702. The base insert cylinder 714 includes a base bottom 716 connected to a base outer wall 718 that extends from the periphery of the base bottom 716. Also extending from the base bottom 716 is a base inner wall 720 that forms a cylinder including a central aperture 722 defining an opening for receiving a pole insert 730 as will be described below. The base insert cylinder 714 additionally includes an annular lid 726 that covers the base insert cylinder 714 to enclose the weighting material placed therein. Annular lid 726 may be disc shaped and include a central aperture 728 to receive the pole insert 730. The annular lid 726 may threadedly engage the base insert cylinder 714 or be interconnected therewith via some other type of latching, locking or securing mechanism.

The opening defined within the base insert cylinder 714 is for receiving the pole insert 730. The pole insert 730 includes a pole insert bottom 732 and a pole insert side wall 734 extending from the periphery of the pole insert bottom 732. A pole insert inner side wall 736 also extends from the bottom of the pole insert bottom 732 and includes a central aperture 738 that extends through the pole insert bottom 732 to enable a pole 724 to extend through the pole insert 730. A pole insert lid 740 comprises an annular ring defining an aperture 742 therein for aligning with the aperture 738 of the pole insert inner side wall 736. The pole insert lid 740 may threadedly engage the pole insert side wall 734 or be secured thereto by some type of latch, locking or other securing mechanism. The pole insert 730 is placed within the aperture 728 and 722 defined within the base insert cylinder 714. The aperture 738 defined within the pole insert 730 then receives the umbrella, sign or flag pole 724.

Finally, the entire mechanism is sealed using a bucket base lid 750. The bucket base lid 750 comprises a disc that defines an opening 752 therein for receiving a staff or flagpole 724. The bucket base lid 750 threadedly engages the side wall 706 of the bucket container housing 702 or alternatively may be secured thereto via a latch, locking mechanism or other type of securing mechanism.

A floatation ring 712 may comprise an inflatable or non-inflatable donut shaped device defining an opening 754 therein for going around the container housing 702. The buoyancy of the floatation ring 712 will then force it upward against the handles 710 of the container housing 702. The floatation ring 712 may comprise a foam or other type of floatation material, or alternatively, may comprise an inflatable ring that may be more easily transported by a user. The float 712 is detachably connected to the container housing 702 to provide resistance for the weight of the container 702 and a mounted pole 724. The floatation ring 712 may be deflated in travel mode but can also be inflated via oral ports or valve stems using a pump. The float 712 may be a standard "pool float" or "inner tube" design. The float 712 could also be encased within a mesh netting to provide added strength and container support.

The opening 752 within the lid 750 may also include some type of locking mechanism 756 for securing the pole 724 inserted therein. The locking mechanism 756 may comprise a compression fitting of correct size to allow for the manual tightening and loosening to secure the pole 724 inserted into the floating base. A compression fitting is a leak-resistant pipe joint designed for a tight filling sleeve that exerts a large inward pressure on the exterior of the pipe. The compression fitting would be sized according to the requirement of the umbrella or flag being supported.

As described with respect to the previous embodiment the components may be formed primarily of common injection molded plastic such as polyethylene, polyvinylchloride and polypropylene but can be made of other flexible materials or components if desired.

Thus, using the above-described configurations a staff or pole of an umbrella, flag or sign may be floatably supported within the water in a useful fashion. It will be appreciated by those skilled in the art having the benefit of this disclosure that this floating shade base for an umbrella provides a water based float for supporting an umbrella, flag, sign staff or pole. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A floating mounting base for supporting a vertical support in water, comprising:

a base housing defining an interior chamber having an opening at a top of the base housing for maintaining a weighting material below a surface of the water and the vertical support in a substantially vertical position, the base housing further defining a support chamber for supporting the vertical support in the substantially vertical position, the base housing further defines an anchor point on an exterior surface of the base housing for securing the floating mounting base to a fixed position;

a lid for enclosing the interior chamber from an external environment, the lid defining an opening aligned with the support chamber enabling the vertical support to be inserted through the lid and into the support chamber; and wherein a bottom of the base housing is insertable within an opening of a float and one of the base housing or the lid defines a surface for engaging the float and preventing the float from moving past the lid.

2. The floating mounting base of claim 1, wherein the support chamber further comprises a conically shaped chamber having a larger diameter at an open end thereof and a smaller diameter at a closed end thereof.

3. The floating mounting base of claim 1 further comprising a gasket for sealing the interior chamber from the external environment.

4. The floating mounting base of claim 3, wherein at least one of the base housing and the lid define a ledge for supporting the gasket.

5. The floating mounting base of claim 4, wherein the lid further defines at least one cup holder therein, the cup holder further securing the gasket in place.

6. The floating mounting base of claim 1, wherein the base housing further comprises a support pillar extending from a bottom of the base housing into the interior chamber, the support pillar defining the support chamber within an interior of the support pillar.

7. The floating mounting base of claim 1, wherein the base housing extends below a surface of the water to a depth at least equal to a width of the base housing.

8. The floating mounting base of claim 1, further including a securing mechanism for securing the lid to the base housing.

9. The floating mounting base of claim 1, wherein the base housing further comprises a lower portion having an outer wall with a first diameter and an upper portion having the outer wall with a second diameter larger than the first diameter, the lower portion and the upper portion interconnected via a horizontal ledge for supporting a gasket to seal the interior chamber from the external environment.

10. A floating mounting base for supporting an umbrella in water, comprising:

a circular base housing defining an interior chamber having an opening at a top of the circular base housing for maintaining a weighting material below a surface of the water to maintain the vertical support in a substantially vertical position, the circular base housing further defines an anchor point on an exterior surface of the circular base housing for securing the floating mounting base to a fixed position;

a support pillar extending from a bottom of the circular base housing into the interior chamber, the support pillar defining a support chamber within an interior of the support pillar for supporting a pole of the umbrella in a substantially vertical position;

a circular lid for enclosing the interior chamber from an external environment, the lid defining an opening aligned with the support chamber enabling the pole of the umbrella to be inserted through the lid and into the support chamber; and wherein a bottom of the circular base housing is insertable within an opening of a float ring and one of the circular base housing or the circular lid defines a surface for engaging the float ring and preventing the float ring from moving past the circular lid.

11. The floating mounting base of claim 10, wherein the support chamber further comprises a conically shaped chamber having a larger diameter at an open end thereof and a smaller diameter at a closed end thereof.

12. The floating mounting base of claim 10 further comprising a gasket for sealing the interior chamber from the external environment.

13. The floating mounting base of claim 12, wherein at least one of the circular base housing and the circular lid define a ledge for supporting the gasket.

14. The floating mounting base of claim 10, wherein the circular lid further defines at least one cup holder therein.

15. The floating mounting base of claim 10, wherein the circular base housing extends below a surface of the water to a depth at least equal to a circumference of the circular base housing.

16. The floating mounting base of claim 10, further including a securing mechanism for securing the circular lid the circular base housing.

17. The floating mounting base of claim 10, wherein the circular base housing further comprises a lower portion having an outer wall with a first diameter and an upper portion having the outer wall with a second diameter larger than the first diameter, the lower portion and the upper portion interconnected via a horizontal ledge for supporting a gasket to seal the interior chamber from the external environment.

18. A floating mounting base for supporting an umbrella in water, comprising:

a circular base housing defining an interior chamber having an opening at a top of the circular base housing for maintaining a weighting material below a surface of the water to maintain the vertical support in a substantially vertical position;

a support pillar extending from a bottom of the circular base housing into the interior chamber, the support pillar defining a support chamber within an interior of the support pillar for supporting a pole of the umbrella in a substantially vertical position; wherein the support chamber further comprises a conically shaped chamber having a larger diameter at an open end thereof and a smaller diameter at a closed end thereof;

a gasket for sealing the interior chamber from the external environment;

a circular lid for enclosing the interior chamber from an external environment, the lid defining an opening aligned with the support chamber enabling the pole of the umbrella to be inserted through the lid and into the support chamber; and wherein a bottom of the circular base housing is insertable within an opening of a float ring and one of the circular base housing or the circular lid defines a surface for engaging the float ring and preventing the float ring from moving past the circular lid.

* * * * *